United States Patent [19]

Posta

[11] 4,433,710

[45] Feb. 28, 1984

[54] POWER PLANING TOOL

[76] Inventor: Antonio D. Posta, 1097 Boston Post Rd., Rye, N.Y. 10580

[21] Appl. No.: 315,966

[22] Filed: Oct. 28, 1981

[51] Int. Cl.[3] ..... B27C 1/10

[52] U.S. Cl. ..... 145/4

[58] Field of Search ..... 145/4, 4.1, 4.2

[56] References Cited

U.S. PATENT DOCUMENTS

| | | | |
|---|---|---|---|
| 1,279,488 | 9/1918 | Broward | 145/4 |
| 1,296,911 | 3/1919 | Bloodgood | 145/4 |
| 1,410,554 | 3/1922 | Dernbach | 145/4 |
| 1,437,925 | 12/1922 | Wagner | 145/4 |
| 1,457,492 | 6/1923 | Bloodgood | 145/4 |
| 1,530,028 | 3/1925 | Billingsley | 145/4 |
| 1,900,336 | 3/1933 | Egan | 145/4 |
| 2,540,258 | 2/1951 | Harris | 145/4 |
| 2,600,859 | 6/1952 | Drysdale | 145/4 |
| 2,649,874 | 8/1953 | Konopa | 145/4 |
| 2,718,248 | 9/1955 | Dimmer | 145/4 |
| 3,443,613 | 5/1969 | Roods | 145/4 |
| 4,363,343 | 12/1982 | Cuneo | 145/4 |

FOREIGN PATENT DOCUMENTS

| | | | |
|---|---|---|---|
| 522687 | 4/1955 | Italy | 145/4 |

*Primary Examiner*—Frederick R. Schmidt
*Assistant Examiner*—J. T. Zatarga
*Attorney, Agent, or Firm*—Morton S. Simon

[57] ABSTRACT

A plane adapted to cut hinge recesses in a door edge is disclosed. The plane housing has a base having a cutout. A rotary cutter, rotatable relative to the base, is mounted from the base and in alignment with the cutout. Means are provided for selectively adjusting the position of the cutter relative to the base. Limiting means are provided for preventing the cutter from cutting across the entire width of an underlying door edge so that the cutter will leave an uncut strip of door edge after a hinge recess is cut in the door edge by the plane. The uncut strip serves to limit lateral movement of the door hinge when it is mounted in the hinge recess cut by the plane. Means are provided for rotating the cutter, such means comprising a first pulley on the cutter, a second pulley, a tensioned belt engaging both pulleys and drive means for the second pulley. Means are additionally provided for maintaining the relative distance between the pulleys substantially constant when the cutter position is selectively adjusted. Means are also provided for limiting travel of the plane on the door edge.

11 Claims, 12 Drawing Figures

FIG.5
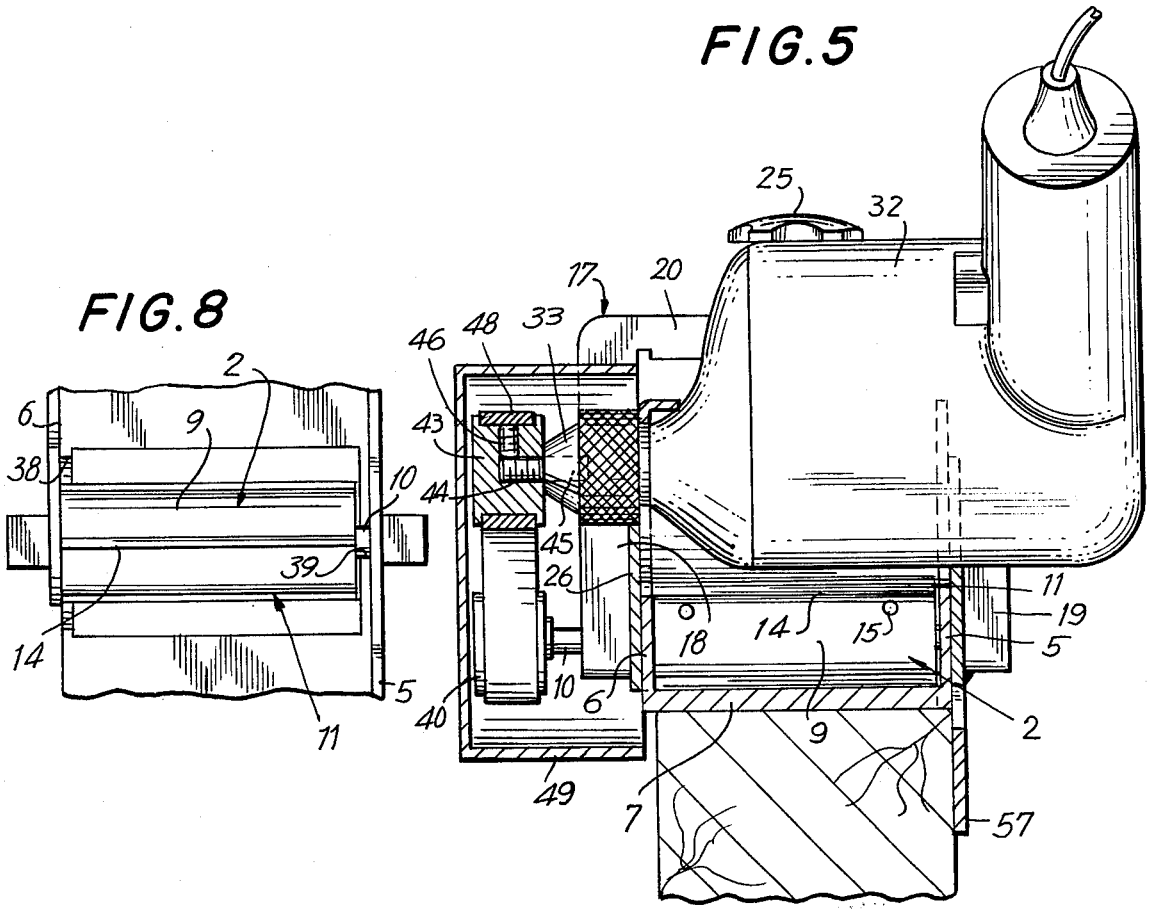
FIG.8
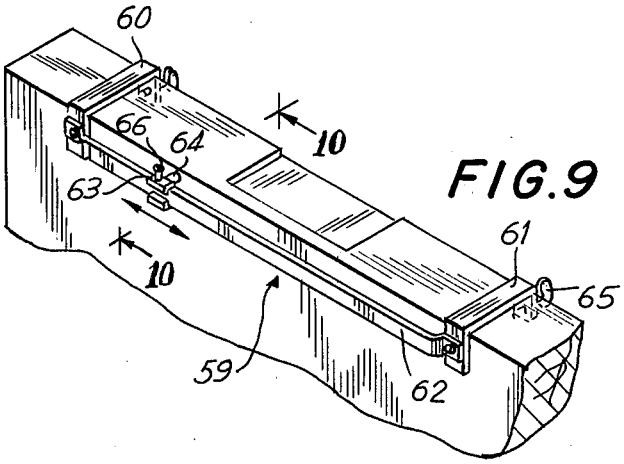
FIG.9
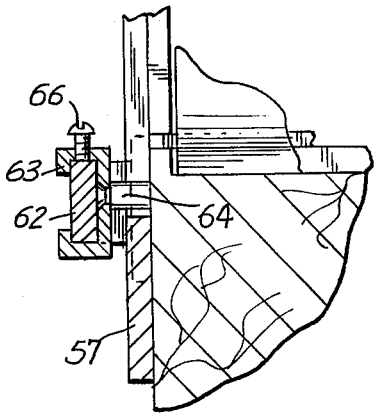
FIG.10

POWER PLANING TOOL

The present invention relates to planing tools. More particularly, it relates to a wood plane adapted to be driven by an electric powered hand drill and especially suited for routing out door hinge recesses and preparing custom moldings.

Power hand tools, for routing out hinge recesses in wooden door edges, are known in the art.

U.S. Pat. No. 2,693,208, issued Nov. 2, 1954 to V. M. Stewart, discloses a tool powered by an electric hand drill. A routing bit cuts out a recess of a predetermined depth and selected width. The routing bit is mounted in the chuck of the drill at one of its ends. A guage pin is provided at the other end of the bit. The guage pin determines the depth of the recess cut by the routing bit. The depth of the hinge recess cannot be greater than the distance between the outer edge of the guage pin to the outer edge of the cutting surface of the routing grooves of the routing bit. Consequently, the Stewart tool is not adjustable. With Stewart's tool, in order to increase the depth of a hinge recess cut in a door edge the router bit must be replaced with a bit having a greater distance between the outer edge of the guide pin to the outer edge of the cutting surfaces of the routing grooves. Another disadvantage of the Stewart tool is that it is unbalanced and extremely awkward to use. This is due to the fact that the weight of the drill is not over the work piece but is instead to the side of it.

Another prior art plane attachment for electric drills is disclosed in U.S. Pat. No. 2,771,104, issued Nov. 20, 1956 to R. J. Saxe. The Saxe tool is disclosed to be particularly adapted for planing the edge of doors. Saxe's cutter unit is, however, fixed in position, relative to the housing. The blades of the cutter unit cannot be raised or lowered. The only way the depth of the cut can be increased is to replace the rotary cutter by one having a larger diameter.

In cutting out a hinge recess in a wood door edge, it is desirable to leave a strip of uncut wood on the door edge. The uncut strip serves as a support for the vertical edge of the door hinge. As is seen in Saxe's FIG. 3, the blade of Saxe's cutter unit cuts across the entire width of the work piece. No supporting strip is left. Thus, the Saxe tool is not suitable for cutting out hinge recesses in door edges.

Yet another prior art portable motor driven plane is disclosed in U.S. Pat. No. 2,718,248, issued Sept. 20, 1955 to W. J. Dimmer. The Dimmer plane can be powered by a portable electric hand drill. In Dimmer's plane, a rotary cutter is supported on a work engaging shoe, which is, in effect, an inverted channel adapted to receive within it a work piece to be cut. During the planing operation, the channel side guide movement of the plane along the surface of the work piece. The Dimmer tool is disadvantageous in that it lacks the feature of adjustability of depth of cut. In Dimmer's tool, the U-shaped bracket, is fixed in position by fasteners and consequently is not adjustable. As is evident from FIG. 3 of the patent, the spacer and the cutter are of the same diameter. Moreover, the spacer lacks the spiral cutting edge present on the cutter. Thus, the Dimmer tool cannot be utilized to cut a hinge recess in a door edge so as to leave an uncut strip of wood on the door edge, which strip is adjacent the vertical edge of the hinge when the hinge is mounted in the recess, and which advantageously serves to support the hinge by limiting its horizontal movement. The Dimmer tool can only cut across the entire width of the door edge. Any attempt to use the Dimmer tool so that it does not cut across the entire edge of a door and leaves an uncut strip of door edge would fail. The spacer would contact the door edge and prevent the cutter from cutting into the door edge wood.

The tool of the present invention remedies the heretofore discussed deficiencies of prior art tools and offers numerous advantages thereover. With the present tool cutting depth may be simply and readily adjusted.

Unlike the Saxe, Stewart and Dimmer tools, there is no need to change the cutter in order to increase the depth of cut. Unlike the Stewart tool, the tool of the instant invention is well-balanced and easy to use. The weight of the tool, as well as the weight of the drill employed to power same, are substantially over the edge of the door. The added weight of the drill on the door edge makes it easier to keep the tool of the present invention in position. Consequently, less force is required in its use by the user.

When employed to rout out a hinge recess in the edge of a wood door, the tool of the present invention, unlike the Dimmer and Saxe tools, leaves a strip of uncut wood on the door edge. When positioned within such recess, the vertical edge of the hinge bears against this strip of uncut wood and horizontal movement of the hinge is thereby limited.

The tool of the present invention, is essentially a power plane, particularly adapted for rapidly and accurately cutting out recesses along the vertical edge of a wood door, which edge recesses are adapted to receive door hinges which when fixed to the door edge recess and to the door jam, serve to hang the door in the door frame.

The blades of the cutting unit of the tool of the instant invention may be rapidly changed so that the tool can also be employed to rout out custom moldings.

To facilitate rapid and accurate routing out of hinge recesses, an accessory guide attachment is provided.

The tool of the present invention will now be described in greater detail with reference to preferred embodiments thereof as shown in the accompanying drawings wherein:

FIG. 5 is a cross-sectional view taken along the line 5—5 of FIG. 2;

FIG. 8 is a partial bottom plan view of the tool of the present invention;

FIG. 9 is a perspective view of an attachment, advantageously used in conjunction with the tool of the present invention, the attachment being mounted on the edge of a door;

FIG. 10 is a partial cross-sectional view taken along the line 10—10 of FIG. 9;

Figures 1, 3, 11, 12:
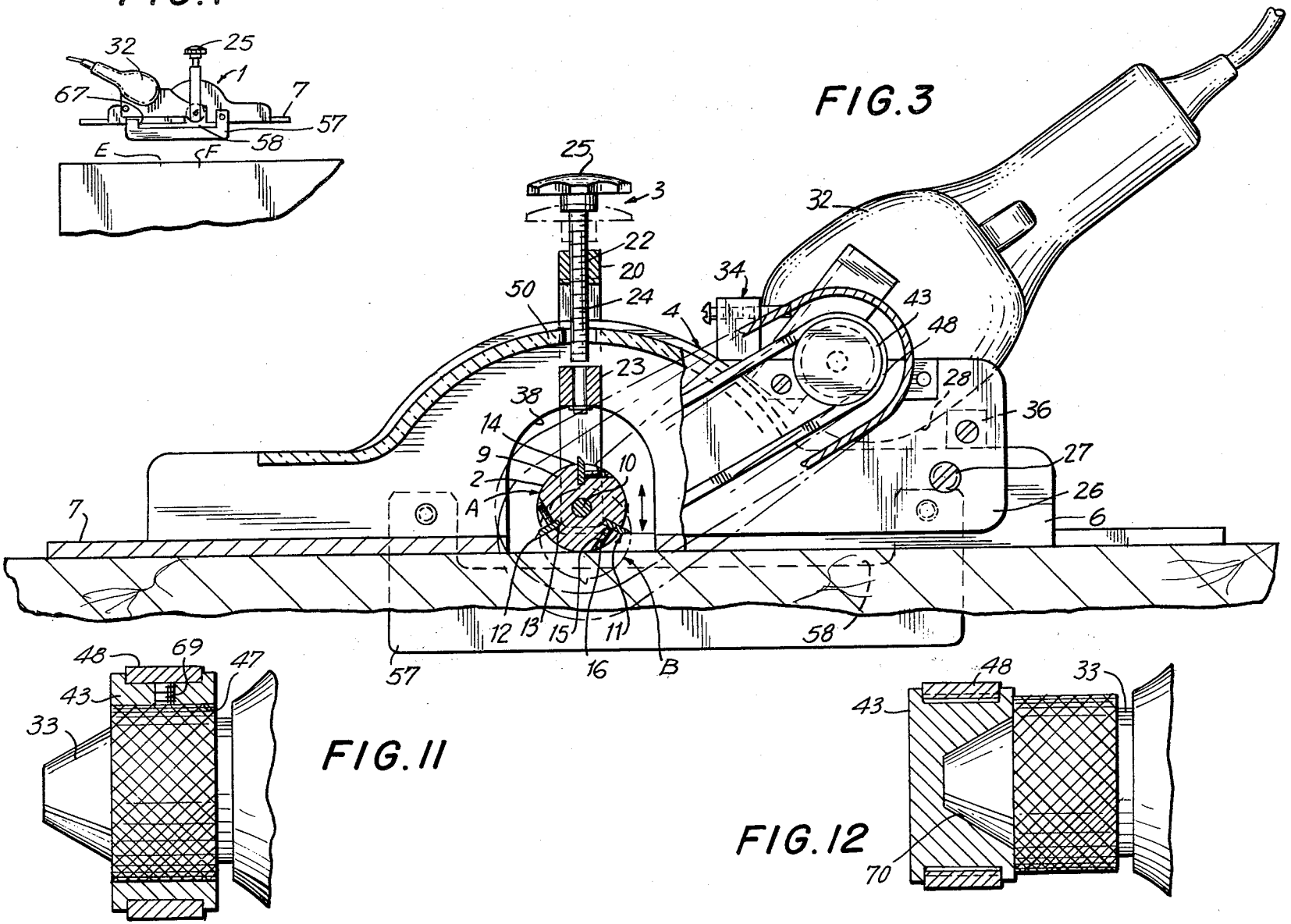
FIG. 1 is a side view of the tool of the present invention shown positioned above a portion of a door edge workpiece.
FIG. 3 is a cross-sectional view taken along the line 3—3 of FIG. 2 showing the cutter is a lowered and in a raised position.
FIG. 11 is a fragmentary view of the attachment of a pulley and drive belt onto the chuck of a conventional electric powered hand drill.
FIG. 12 is a view similar to FIG. 11 of another embodiment.

Referring now to the drawings; as shown in FIG. 3, the tool of the present invention comprises a housing 1, a rotary cutter 2, means on the housing for selectively moving the cutter into and out of engagement with the surface of a workpiece to be cut 3 and means for driving the cutter 4.

Figure 2:
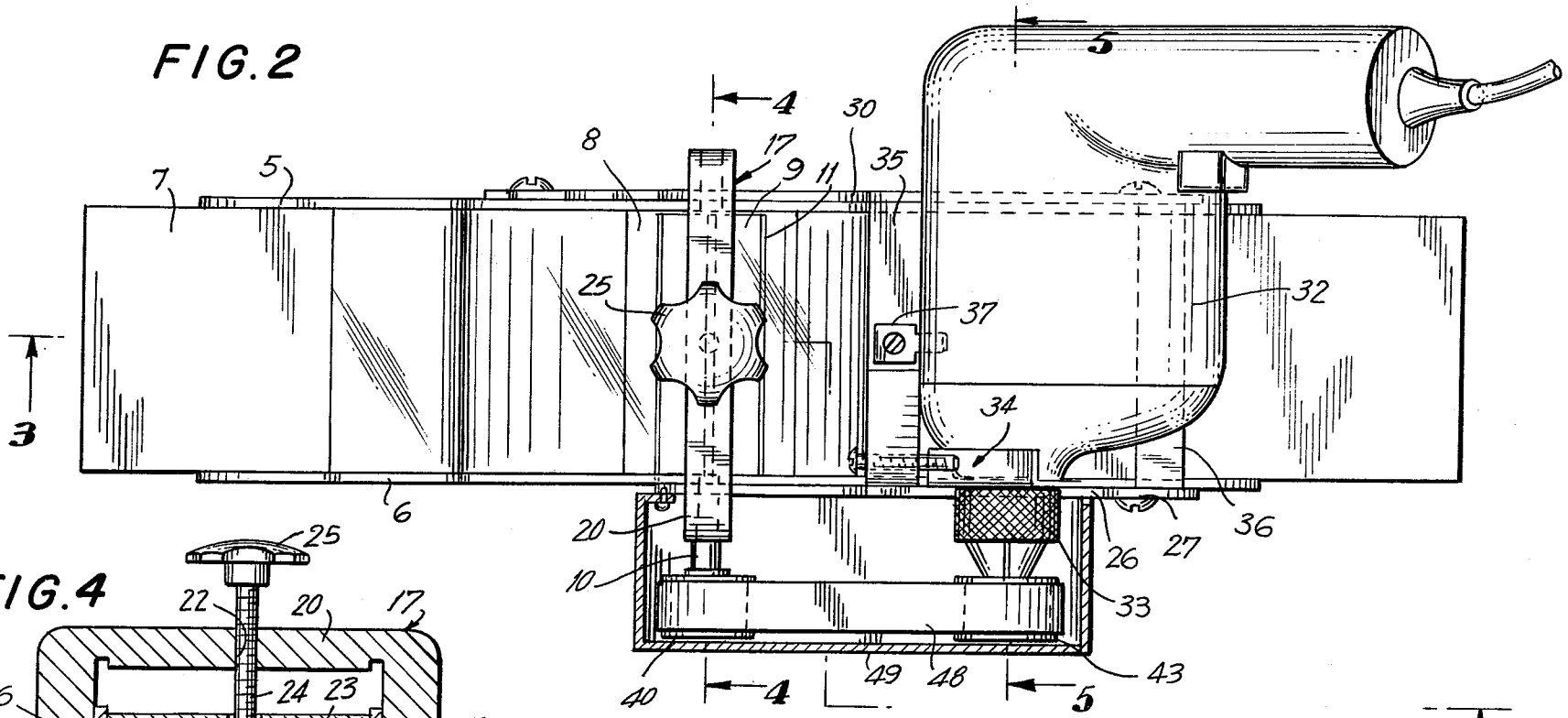
FIG. 2 is a top plan view of the tool of the present invention with part shown in cross-section.
Figure 4:
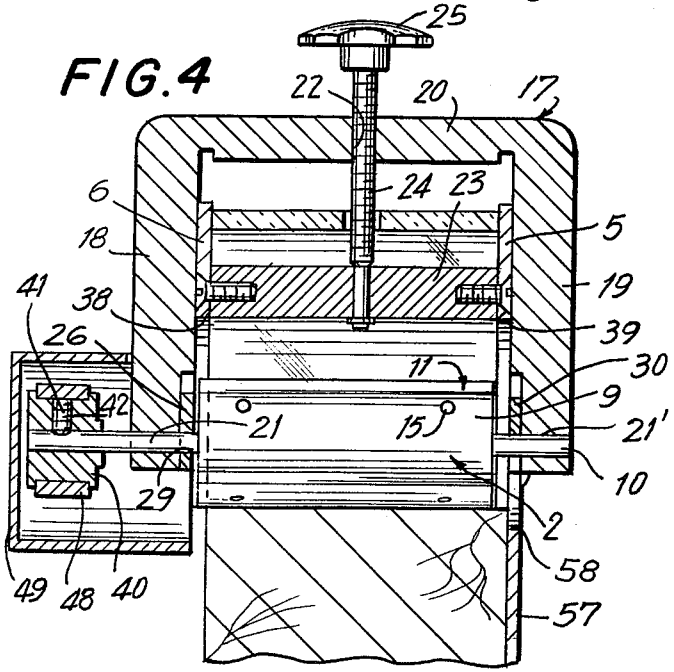
FIG. 4 is a cross-sectional view taken along the line 4—4 of FIG. 2.

As shown in FIGS. 4 and 5, the housing 1 is, in cross-section, substantially a channel comprised of a first upwardly extending side 5, a second upwardly extending side 6, and a base 7 extending between sides 5 and 6 and affixed to each. As shown in FIG. 2, base 7 has a cutout portion 8 adapted to receive cutter 2 therethrough.

Housing 1 is preferably of unitary construction; however, it can be comprised of separate components 5, 6 and 7, joined to one another by welding, bolt, machine screw or the like. Housing 1 may be made of aluminum, steel or any light weight metal or metal alloy, or for that matter, may be made of plastic. Aluminum is preferred.

As shown in FIGS. 3 and 8, cutter 2 is comprised of a cylindrical body 9 having a central drive axle 10 so that body 9 is movable with drive axle 10, and at least one, preferably a plurality, of removeable cutting blades 11 each having a cutting edge 12 and a shank 13. Body 9 is provided with a longitudinal slot 14 adapted to removably receive therein shank 13 of cutting blade 11. For each cutting blade 11 a corresponding slot 14 is provided.

As shown in FIG. 3, body 9 is additionally provided with threaded bores 15 and complimentarily threaded hex nuts 16 adapted to be threaded within bores 15 into engagement with the shanks 13 of the blades 11 so as to fix the blades 11 within the slots 14. This arrangement facilitates ready interchangeability of blades 11 allowing the user to select blades of a particular configuration and cutting edge, for example, when utilizing the tool for routing custom moldings.

As shown in FIG. 4, substantially U-shaped unitary bridge 17, having a first downwardly extending arm 18, a second downwardly extending arm 19 and a third horizontal arm 20, joining arms 18 and 19 and unitary therewith, serves to support cutter 2. Arms 18 and 19 respectively contain bores 21 and 21' into which the central drive axle 10 of body 9 of cutter 2 is journaled.

Arm 20 contains a threaded vertical bore 22. A horizontal truss 23 is fixed at one end to side 5 and at its other end to side 6 of housing 1. A vertical member 24 is perpendicularly fixed at one of its ends to truss 23, preferably centrally between sides 5 and 6 of housing 1. Member 24 is complimentarily threaded to the threaded bore 22 in arm 20 and is threadably engaged therein. At is other end, member 24 is provided with an enlarged thumb screw-like head portion 25 so that turning of headportion 25, via the thumb and forefinger, in one direction will move cutter 2 upwards relative to the base 7 of the housing 1 or downwards relative to the base 7 when the head portion 25 is turned in the opposite direction.

As is shown in FIG. 3, a first lever arm 26 is pivotably mounted at one end 27 on the side 6 of the housing 1 and at its other end is journaled on arm 18 of bridge 17 and is provided with a cutout 28. More precisely, lever arm 26 possesses a bore 29 adapted to receive axle 10. As seen in FIG. 4, the lever arm 26 is mounted on axle 10 between arm 18 and cutter 2. A second lever arm 30 is pivotably mounted at one end on side 5 of housing 1 and at its other end is journaled on the arm 19 of bridge 17 and is provided with a cutout 31 (not shown). Cutouts 28 and 31 are aligned and are adapted to respectively support thereon, as illustrated in FIGS. 2 and 5, the body 32 and chuck 33 of an electric portable hand drill. Locking means 34 are provided on the first lever arm 26 so that when the chuck 33 of the drill is within the cutout portion 28 locking means 34 will engage the chuck 33 and hold it firmly in position.

When the electric powered hand drill is in position the handle of the electric drill, as is seen in FIG. 2, serves as a convenient handle for operation of the plane of the present invention. The handle of the drill is conveniently held with the right hand. The left hand grasps the thumb screw-like head portion 25 to guide forward motion of the plane.

As stated heretofore, lever arm 26 is journaled on the central drive axle 10 of cylindrical body 9 and is positioned between side 5 of housing 1 and arm 18 of bridge 17. The second lever arm 30 is similarly mounted. It is journaled at one end on the central drive axle 10, between side 5 of housing 1 and arm 19 of bridge 17, and as stated previously, is pivotably mounted at its other end, on side 5.

A first brace 35 and a second brace 36 extend respectively between lever arms 26 and 30 and are affixed thereto. Braces 35 and 36 provide further support for the body 32 of the hand drill. Means are provided on brace 35 for fixing the position of the body 32 of the hand drill on the housing 1. As shown in FIG. 2, such means comprise a pin 37 removably mounted on brace 35. Pin 37 is removed and the drill is positioned on the housing 1 so that chuck 33 is supported by cutout portion 28 and the body 32 is supported by cutout portion 31. Pin 37 is then reaffixed to brace 35 so that it contacts the body 32 of the drill and fixes the position of the drill on the housing 1.

As shown in FIGS. 3 and 8, side 6 of housing 1 has a U-shaped cutout 38. Side 5 of housing 1 has a U-shaped cutout 39. Downward threading of the thumb screw-like head portion 25 causes the cutter 2 to move downwards within the U-shaped cutout 38 from raised position A of FIG. 3 to a lowered position B at which point the cutter 2 extends through the cutout portion 8 of base 7 of the housing 1. At position B blades 11 will be able to contact the workpiece and cut same.

The position of the cutter 2 may be infinitely varied between an uppermost point, limited only by the size of cutout portions 38 and 39, and a bottommost point, limited by the length of vertical member 24 and the length of arms 18 and 19.

As shown in FIG. 3, as the cutter 2 is lowered, lever arms 26 and 30 pivot downwardly.

As shown in FIG. 4, bores 21 and 21' in arms 18 and 19, respectively, pass completely through said arms so that the central drive axle 10 of body 9 of cutter 2, which is journaled in said bores, is rotatable therein. The central drive axle 10 extends a sufficient length through bore 21 so that a pulley 40 may be affixed thereto, for rotation therewith, by means of a recessed hexnut 41 complimentarily threaded to a threaded bore 42 in pulley 40.

As is seen in FIG. 5, drill chuck 33 is removeably engaged to a second pulley 43.

FIG. 5 shows one embodiment of a manner of affixing the second pulley 43 to chuck 33. In this embodiment, pulley 43 has a central longitudinal axial first bore 44 adapted to receive therein a pin 45. A threaded second bore 46 communicates with the first bore 44 and is adapted to threadibly receive a hexnut which when screwed into said bore engages pin 45 and fixes the position of pulley 43 thereon. This permits lateral adjustment of the position of pulley 43 relative to the chuck 33 and allows for alignment of pulley 43 and pulley 40.

FIGS. 11 and 12 show alternate embodiments of the manner in which the second pulley 43 may be affixed to drill chuck 33. In the embodiment of FIG. 11, the second pulley 43 possesses a horizontal axial bore 47 adapted to removeably receive therethrough chuck 33. When chuck 33 is within bore 47 the pulley 43 is affixed to chuck 33 by means of a threaded hexnut threadible in a complimentary threaded bore 69 which communicates with bore 47, so that the hexnut engages the chuck 33 and fixes the pulley 43 to the chuck 33.

FIG. 12 shows yet another means of affixing the second pulley 43. In the embodiment of FIG. 12, the pulley is provided with a female recess 70 adapted to receive chuck 33 therein in a manner such that there is sufficient frictional interaction between the surface of the chuck and the walls of the recess to fix the pulley 43 to the chuck 33.

Pulley 43 is rotated by drill chuck 33 of the electric hand drill. This rotation is translated by pulley 40 and from pulley 40 to cutter 2 by means of drive belt 48. Since the drill chuck 33 pivots with cutter 2 as the cutter is raised or lowered relative to cutout 8, the distance between pulleys 40 and 43 remain substantially constant and there is no slackening or tightening of the belt 48 when the cutter 2 is raised or lowered.

Drive belt 48 can be a standard drive belt, as shown in FIG. 11. Preferably drive belt 48 is, as shown in FIG. 12, a timing belt having teeth which mesh with complimentary teeth on pulleys 40 and 43.

For safety sake, as shown in FIGS. 2 and 4, pulleys 40 and 43 and drive belt 48 are encased by a guard 49 removably mounted on lever arm 26.

As shown in FIG. 3, as another safety measure, a second guard 50 is provided on housing 1 to prevent accidental injury to the fingers by cutter 2. Guard 50 overlays base 7 and is mounted on and between sides 5 and 6. Guard 50 also serves to direct wood chips away from the area being cut.

FIG. 1 illustrates the use of the tool of the present invention in conjunction with positioning guide 57. Guide 57 is removably mounted on side 5 of housing 1. Guide 57 is mounted parallel to side 5 so that it extends, vertically, below the horizontal plane of base 7. Guide 57 is substantially U-shaped, the legs and base of the U forming with the edge of the base 7 of housing 1, a slot 58.

As shown in FIG. 1, when one wishes to cut a hinge recess in a door edge work piece all one need do is mark the door edge with the point (E) at which the recess is to begin and the point (F) at which the recess is to end. The tool is then placed on the door edge so that guide 57 contacts the side of the door and marked points E and F are visible through slot 58. The tool can then be moved back and forth between points E and F, while guide 57 contacts the side of the workpiece, to cut out a hinge recess therebetween.

FIGS. 9 and 10 illustrate travel limiting attachment 59 adapted to cooperate with guide 57. Basically limiting attachment 59 serves to restrict forward motion of the housing 1 on the door edge workpiece to a selected predetermined maximum forward point. As shown more fully in FIG. 9, limiting attachment 59 is comprised of a first inverted substantially U-shaped arm 60, a second inverted substantially U-shaped arm 61, and a third arm 62, affixed at one end to the first arm 60 and at its other end to the second arm 61, and a guide pin 63, moveable along the third arm 62 and adapted to be selectively fixed in position at a desired position along the length of the third arm 62.

Guide pin 63, which is preferably in releasable frictional engagement with the third arm 62, has a stop 64. Means are provided on at least one of arms 60 and 61, and preferably on each of said arms, for fixing limiting attachment 50 to the workpiece. Preferably such means comprise a thumb screw 65 on each of said arms 60 and 61 threadably engaged in a comlimentary threaded bore in each of said arms whereby threading of the thumb screw against the work piece frictionally locks limiting attachment 59 in position on the workpiece.

Once the limiting attachment is affixed to the door edge workpiece the guide pin 63 is slid along arm 62 to the desired position at which point it is fixed to arm 62 by, for example, threading bolt 66 into a complimentary threaded bore in guide pin 63, said bore communicating with arm 62, so that the bolt contacts and frictionally engages arm 62.

Basically the limiting attachment 59 and guide 57 cooperate as follows:

Rather than marking the door edge workpiece as shown in FIG. 1, the limiting attachment is affixed to the door edge as heretofore described. The tool is then positioned over the door edge as shown in FIG. 1, so that the stop 64 extends into slot 58 and guide 57 contacts the side of the door. When the tool engages the surface of the workpiece and is moved forward thereon with guide 57 in contact with the side of the door the stop 64 will contact end 67 of slot 58 and forward motion of the tool will be halted. It is obvious that by appropriate setting of the position of guide pin 63 along arm 62 recesses of a desired length can be preselected.

As stated previously, when employed to cut hinge recesses in door edges, the tool of the present invention advantageously leaves a strip of uncut door edge which lends further support to the hinge by limiting horizontal movement of the hinge in the recess.

Figure 7:
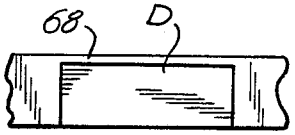
FIG. 7 is a partial view of a cut made in a door edge, using the tool of the present invention.
Figure 6:
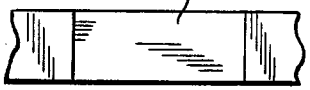
FIG. 6 PRIOR ART
FIG. 6 is a partial view of a cut made in a door edge, using a conventional plane.

Prior art devices cut hinge recesses across the entire width of the door edge producing a cut out recess (C) as depicted in FIG. 6. The tool of the present invention produces a cutout recess (D) with an uncut strip of wood 68 being left in the wood of the door edge as shown in FIG. 7.

As shown in FIG. 8, the blades 11 of cutter 2 do not span the entire width of the base 7. At one end, blades 11 are substantially flush with the edge of the outer wall of side 6 and, at their outer end, blades 11 are adjacent the inner wall of side 5. Consequently, with use of the tool of the present invention an uncut strip of door edge wood 68 is left.

The present invention has been described with reference to particularly preferred embodiments thereof. One skilled in the art to which the invention relates will readily appreciate that numerous modifications can be made to the present tool and attachments without departing from the scope and spirit of the invention. For example, the tool can be set up on a bench having a recess on its upper surface adapted to receive therein the tool with the base 7 facing upwards, inotherwords, with the bottom surface of base 7 being substantially in the same plane as the bench top. In such position the tool may be employed as a table type router and/or plane.

What is claimed is:

1. A plane, adapted to cut a hinge recess in a door edge, comprising a housing having a base having a cutout therethrough, the cutout being dimensioned so that it begins at a first edge of the base, extends axially across the base and ends short of a second edge of the base opposite the first edge, the cutout being substantially U-shaped;

a rotary cutter mounted for rotation relative to the base, the cutter being mounted from the housing and in alignment with the cutout;

means, mounted from the housing, for selectively adjusting the position of the cutter relative to the base so that when the cutter is at a first position the cutter extends through the cutout to a point below the bottom plane of the base and can contact and cut an underlying door edge, and when the cutter is at a second position the cutter does not extend through the cutout to a point below the bottom plane of the base and cannot contact and cut an underlying door edge;

limiting means, mounted from the housing, for preventing the cutter from cutting across the entire width of an underlying door edge when the cutter is at the first position and in cutting contact with an underlying door edge so that an uncut strip of door edge is left after a hinge recess is cut therein by the plane, the uncut strip serving to limit lateral movement of a door hinge mounted in the hinge recess;

means, mounted from the housing, for rotating the cutter, the means for rotating comprising a first pulley on the cutter, a second pulley, mounted from the housing, a tensioned drive belt engaging the first pulley and the second pulley and means for driving the second pulley;

means, mounted from the housing, for maintaining the position of the first pulley and the second pulley, relative to one another, substantially constant when the position of the cutter is adjusted so that substantially constant tension on the drive belt is maintained; and means, mounted from the housing, for limiting travel of the plane along the underlying door edge, said means for limiting travel comprising a guide mounted from the housing adjacent the second edge, the guide extending below the bottom plane of the base and being substantially perpendicular to the base, the guide having a cutout, the cutout in the guide and the second edge of the base forming there between a longitudinal slot closed at its ends, a guide pin removable positionable in the slot, and means, removably attachable to a door, for fixing the guide pin at a desired limiting position on the door whereby when the guide pin is in the slot and the plane is moved along the door edge travel of the plane will be halted when the end of the slot contacts the guide pin within the slot.

2. The plane, as claimed in claim 1, wherein the means for fixing the guide pin to a door comprises a first U-shaped member a second U-shaped member and a positioning track, the positioning track being fixed to the first U-shaped member at one end and to the second U-shaped member at its other end; the U-shaped members being adapted to engage the door edge at least one of the U-shaped members having means for frictionally engaging the side of the door so that the U-shaped member is fixed in position relative to the side of the door; the guide pin is mounted on and slidably moveble along the positioning track; means are provided on the guide pin for fixing the position of the guide pin at a desired point on the track; the track is offset at each of its ends so that the guide can be inserted between the track and the side of the door underlying the track and into contact with the side of the door; and the guide pin extends laterally from the track toward the door and into the longitudinal slot.

3. A plane, adapted to cut a hinge recess in a door edge, comprising a housing having a base having a cutout therethrough, a first side fixed to one edge of the base and a second side disposed opposite the first side and fixed to another edge of the base whereby the housing is channel shaped;

a rotary cutter mounted for rotation relative to the base, the cutter being mounted from the housing and in alignment with the cutout;

means, mounted from the housing, for selectively adjusting the position of the cutter relative to the base so that when the cutter is at first position the cutter extends through the cutout to a point below the bottom plane of the base and can contact and cut an underlying door edge, and when the cutter is at a second position the cutter does not extend through the cutout to a point below the bottom plane of the base and cannot contact and cut an underlying door edge;

limiting means, mounted from the housing, for preventing the cutter from cutting across the entire width of an underlying door edge when the cutter is at the first position and in cutting contact with an underlying door edge so that an uncut strip of door edge is left after a hinge recess is cut therein by the plane, the uncut strip serving to limit lateral movement of a door hinge mounted in the hinge recess;

means, mounted from the housing, for rotating the cutter, the means for rotating comprising a first pulley on the cutter, a second pulley mounted from the housing, a tensioned drive belt engaging the first pulley and the second pulley and means for driving the second pulley;

means, mounted from the housing, for maintaining the position of the first pulley and the second pulley, relative to one another, substantially constant when the position of the cutter is adjusted so that substantially constant tension on the drive belt is maintained;

a cross brace member extending horizontally between and affixed to each of the first and the second sides;

the means for selectively adjusting the position of the cutter is a support having a first downwardly extending arm, a second downwardly extending arm and a third horizontally extending arm disposed between the first arm and the second arm and joined at one of its ends to the first arm and at another of its ends to the second arm whereby the support substantially has the shape of an inverted U;

the means for maintaining the position of the first pulley and the second pulley, relative to one another, substantially constant comprises a first lever arm pivotally mounted at one of its ends from the first side and mounted for movement with the first arm at its other end, a second lever arm pivotally mounted from the second side at one of its ends and mounted for movement with the second arm at its other end, the cutter has a central axle and is positioned between the first arm and the second arm, the central axle of the cutter is journaled in the first lever arm and the first arm and is journaled in the second lever arm and the second arm, the central axle is journaled in the first arm of the support and in the second arm of the support, the central axle has an extension, the first pulley is mounted from the central axle extension, the second pulley is mounted from the second lever arm and in alignment with the first pulley, the horizontal arm of the support has a vertically extending threaded bore therethrough, an adjustment member, complimentarily threaded to the threaded bore in the horizontal arm of the support, is in threadible engagement with the threaded bore, the adjustment member has a head portion for facilitating turning of the adjustment member, the adjustment member is fixed at its bottom to the cross brace whereby when the head of the adjustment member is turned in one direction the cutter is lowered relative to the cutout in the base and the first and second lever arms simultaneously pivot downwardly and when the head of the adjustment member is turned in the opposite direction the cutter is raised relative to the cutout in the base and the first and second lever arms simultaneously pivot upwardly, the movement of the lever arms relative to the movement of the cutter being such that the distance between the first and second pulleys is maintained substantially constant throughout such movement.

4. The plane, as claimed in claim 3, further including means on one of the lever arms for removably mounting a portable electric power drill so that the chuck of such drill is in drivable contact with the second pulley and the handle of the drill is positioned such that it serves as a handle for the plane.

5. The plane, as claimed in claim 4, wherein the second pulley has a central bore adapted to removably receive and frictionally affix therein the chuck of the drill.

6. The plane, as claimed in claim 4, wherein the second pulley has a central bore adapted to receive the chuck of the drill, the pulley has a threaded second bore communicating with the first bore, and the second bore contains a complimentarily threaded screw which is threadible to engage and fix the chuck of the drill in the central bore.

7. The plane, as claimed in claim 3, further including a first guard removably mounted from the housing and disposed over the first pulley, the second pulley, and the belt, the first guard being adapted to prevent accidental contact of an operator's fingers with the pulleys during operation of the plane; and a second guard mounted from the first side and the second side and extending there between the guard being positioned so that it overlies that portion of the housing where the rotary cutter is positioned so that the second guard prevents accidental contact of an operator's fingers with the cutter during operation of the plane.

8. The plane, as claimed in claim 3, wherein the cutout is dimensioned so that it begins at a first edge of the base, extends axially across the base and ends short of a second edge of the base opposite the first edge and the cutout is substantially U-shaped.

9. The plane, as claimed in claim 3, further including means, mounted from the housing, for limiting travel of the plane along the underlying door edge.

10. The plane, as claimed in claim 9, wherein the means for limiting travel comprises a guide mounted from the housing adjacent the second edge, the guide extending below the bottom plane of the base and being substantially perpendicular to the base, the guide having a cutout, the cutout in the guide and the second edge of the base forming there between a longitudinal slot closed at its ends, a guide pin removably positionable in the slot, and means, removably attachable to a door, for fixing the guide pin at a desired limiting position on the door whereby when the guide pin is in the slot and the plane is moved along the door edge travel of the plane will be halted when the end of the slot contacts the guide pin within the slot.

11. The plane, as claimed in claim 8, wherein the cutter is dimensioned such that when the cutter is at the first position it extends from a point in the cutout at the first edge of the base to a point adjacent the edge of the cutout that is short of the second edge of the base.

* * * * *